US007739772B2

(12) United States Patent
Park

(10) Patent No.: US 7,739,772 B2
(45) Date of Patent: Jun. 22, 2010

(54) UPRIGHT VACUUM CLEANER

(75) Inventor: Tae Jin Park, Kimhae-si (KR)

(73) Assignee: LG Electronics, Inc., Seoul (KR)

( * ) Notice: Subject to any disclaimer, the term of this patent is extended or adjusted under 35 U.S.C. 154(b) by 719 days.

(21) Appl. No.: 11/300,441

(22) Filed: Dec. 15, 2005

(65) Prior Publication Data

US 2006/0254019 A1 Nov. 16, 2006

(30) Foreign Application Priority Data

May 12, 2005 (KR) ..... 10-2005-0039695

(51) Int. Cl.
*A47L 9/26* (2006.01)

(52) U.S. Cl. ..... 15/323

(58) Field of Classification Search ..... 15/323, 15/351; 242/385–385.4
See application file for complete search history.

(56) References Cited

U.S. PATENT DOCUMENTS 2,854,686 A * 10/1958 Hansen ..... 15/327.5
3,757,382 A * 9/1973 Brooks et al. ..... 15/389
4,106,165 A * 8/1978 Clowers et al. ..... 24/134 R
4,377,882 A * 3/1983 Dyson ..... 15/335
4,446,594 A * 5/1984 Watanabe et al. ..... 15/323
4,905,341 A * 3/1990 Sunagawa et al. ..... 15/323
5,168,598 A * 12/1992 Hashizume et al. ..... 15/323
6,052,862 A * 4/2000 Lowery ..... 15/323
6,237,188 B1 * 5/2001 Takemoto et al. ..... 15/346
6,502,778 B2 * 1/2003 Kim ..... 242/385.4
6,574,827 B2 * 6/2003 Hashizume et al. ..... 15/339
6,779,229 B2 * 8/2004 Lee et al. ..... 15/329
7,273,192 B2 * 9/2007 Park ..... 242/385.2
2004/0006842 A1 * 1/2004 Lee et al. ..... 15/351
2005/0224624 A1 * 10/2005 Park ..... 242/385.4

* cited by examiner

*Primary Examiner*—David B Thomas
(74) *Attorney, Agent, or Firm*—McKenna Long & Aldridge, LLP

(57) ABSTRACT

There is provided an upright vacuum cleaner that can be conveniently and stably operated. In the upright vacuum cleaner, an intake nozzle is provided to suck air, dust, and other material, a body is extended upward from the intake nozzle in a rotatable relationship with the intake nozzle, a dust collector is installed in the body to remove the dust and other material from the air, and a cord reel is installed on one side of the body to accommodate a power cord.

4 Claims, 4 Drawing Sheets

UPRIGHT VACUUM CLEANER

This application claims priority to Korean Applications 10-2005-0039695 filed on May 12, 2005, which is incorporated by reference, as if fully set forth herein.

BACKGROUND OF THE INVENTION

1. Field of the Invention

The present invention relates to a vacuum cleaner, and more particularly, to an upright vacuum cleaner of which power cord can be readily extended and retracted. The present invention further relates to an upright vacuum cleaner that has a cord reel at a side for an easy use of a power cord.

2. Description of the Related Art

Vacuum cleaners are electrical appliances that clean surfaces such as carpets and upholstery by sucking dust and other material. Generally, vacuum cleaners are of two types: the canister type, which has an intake nozzle detachably installed to a main body, and the upright type, which has an intake nozzle formed integral with a main body.

The upright type vacuum cleaner has an elongated shape in a vertical direction, such that it is convenient for a user to move a main body of the cleaner while operating the cleaner. The upright type vacuum cleaner includes an intake nozzle to suck dirt and other material from surfaces, a main body in which suction power generating unit is installed, and a handle formed on the main body for a user to hold.

The suction power generating unit may include a motor and a suction fan coupled to the motor. The suction fan generates suction force to draw foreign substances together with air through the intake nozzle. Also, the upright type vacuum cleaner includes a detachable dust collector in the main body to collect the sucked foreign substances from the air.

Further, the upright type vacuum cleaner includes a power cord to receive power from an outer power source. Though the vacuum cleaner can clean more wide area with a longer power cord, it is uncomfortable to carry or keep the vacuum cleaner with the longer power cord when the vacuum cleaner is not used. Therefore, the length of the power cord is limited to a predetermined level. Nevertheless, the length of the power cord exceeds at least several meters, such that when the upright vacuum cleaner is not used, the power cord is kept in a wound or bent condition.

Generally, the upright type vacuum cleaner includes vertically spaced protrusions at a back to keep the power cord by winding it around the protrusions.

However, this way of keeping the power cord is disadvantageous in several respects.

The wound power cord is readily freely unwound, especially while moving the upright vacuum cleaner, thereby discomforting a user. Also, when the power cord is freely unwound, it can be damaged by accident.

Further, the user has to unwind the power cord before using the upright vacuum cleaner and wind the power cord after using the upright vacuum cleaner. This may be very inconvenient to the user. Furthermore, the power cord degrades the appearance of the upright vacuum.

SUMMARY OF THE INVENTION

Accordingly, the present invention is directed to an upright vacuum cleaner that substantially obviates one or more problems due to limitations and disadvantages of the related art.

An object of the present invention is to provide an upright vacuum cleaner of which power cord can be readily extended and retracted.

Another object of the present invention is to provide an upright vacuum cleaner that has a cord reel at a side for an easy operation of the upright vacuum cleaner.

A further another object of the present invention is to provide an upright vacuum cleaner in which a cord reel and an exhaust unit are respectively installed on both sides in a symmetric manner for a balanced and easy operation of the upright vacuum cleaner.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an upright vacuum cleaner including: an intake nozzle to suck air, dust, and other material; a body extended upward from the intake nozzle in a rotatable relationship with the intake nozzle; a dust collector installed in the body to remove the dust and other material from the air; and a cord reel installed on one side of the body to accommodate a power cord.

In another aspect of the present invention, there is provided an upright vacuum cleaner including: an intake nozzle to suck air, dust, and other material; a body extended upward from the intake nozzle; a dust collector installed in the body to remove the dust and other material from the air; a cord reel installed on one side of the body to accommodate a power cord; and an exhaust unit formed on the other side of the body to discharge the air from the dust collector to an outside of the upright vacuum cleaner.

In a further another aspect of the present invention, there is provided an upright vacuum cleaner including: an intake nozzle to suck air, dust, and other material; a body extended upward from the intake nozzle; a dust collector installed in the body to remove the dust and other material from the air; a handle extended upward from the body and then bent backward at a predetermined angle; and a cord reel installed on a side of the body to accommodate a power cord.

According to the present invention, the upright vacuum cleaner can be operated more conveniently with a more beautiful appearance. Also, the upright vacuum cleaner is properly balanced for an easy operation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
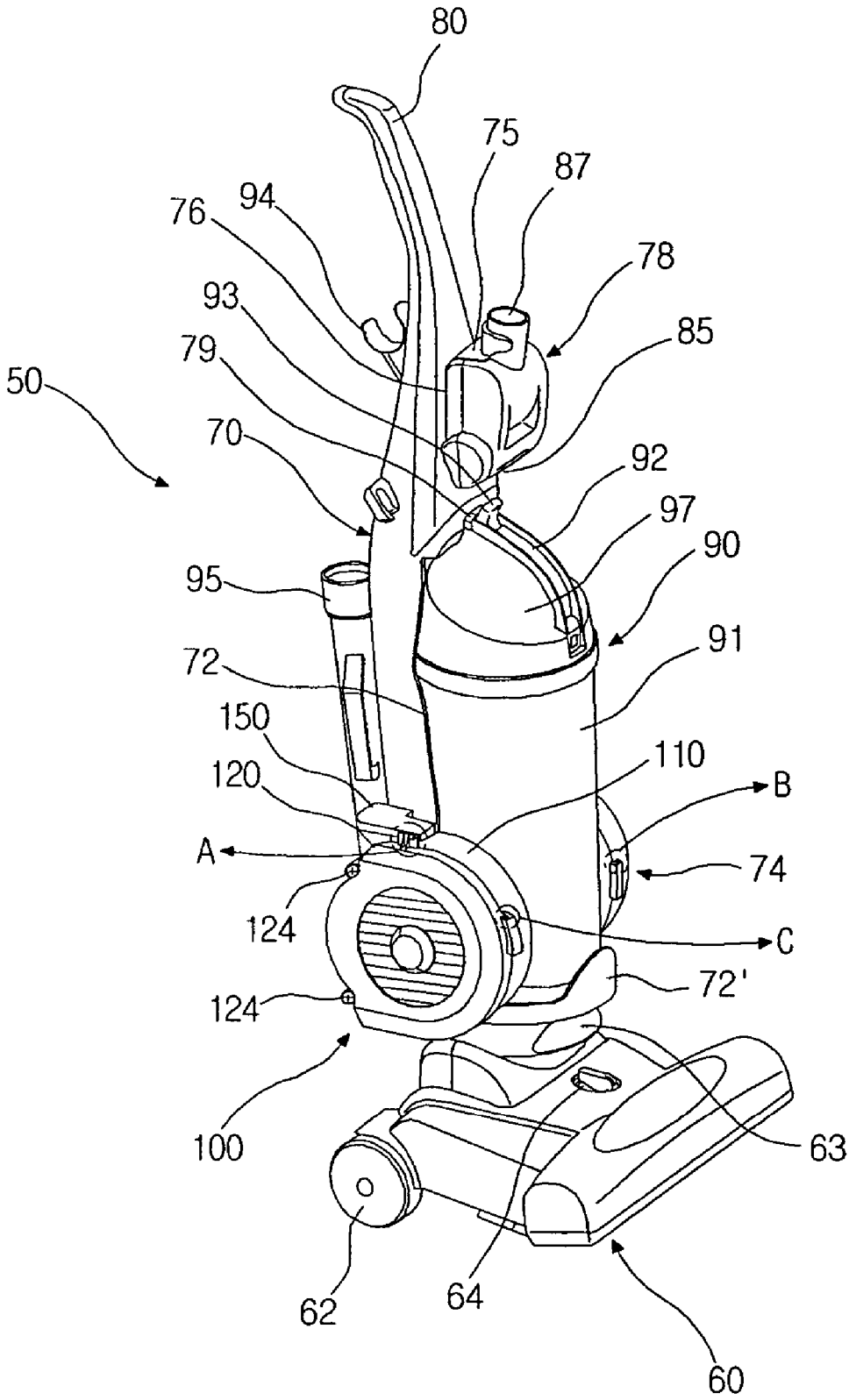
FIG. 1 is a perspective view of an upright vacuum cleaner according to the present invention.
Figure 2:
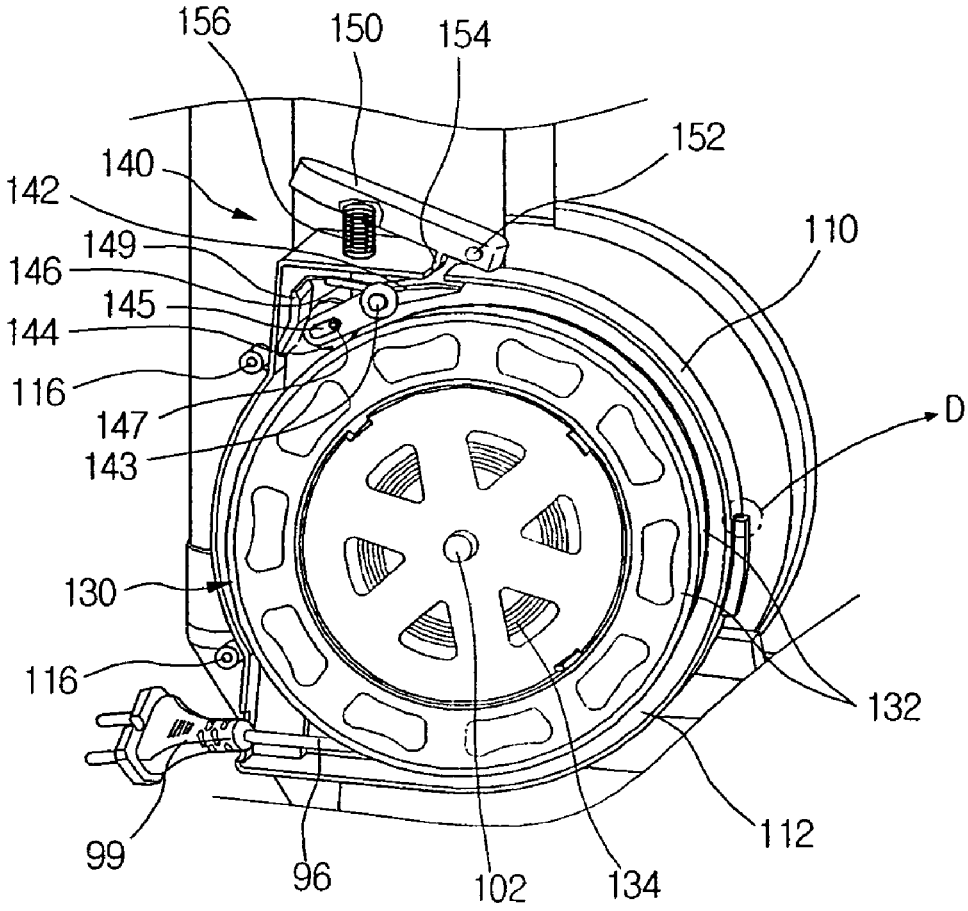
FIG. 2 is an enlarged perspective view of a cord reel of the upright vacuum cleaner depicted in FIG. 1.

FIG. 1 is a perspective view of an upright vacuum cleaner according to the present invention, and FIG. 2 is an enlarged perspective view of a cord reel of the upright vacuum cleaner depicted in FIG. 1.

Referring to FIGS. 1 and 2, an upright vacuum cleaner 50 includes an intake nozzle 60 to suck dirt and other material from surfaces, a body 70 in which suction power generating unit is installed, and a handle 80 formed on the body 70 for a user to hold.

The handle 80 is upwardly extended from the body 70 and bent backward to provide a comfortable grasping.

The intake nozzle 60, as it is moved slightly above a surface, sucks air through a suction hole defined therein. That is, through the suction hole of the intake nozzle 60, dust and other material are sucked together with air. Generally, a traveling wheel 62 is provided at a rear bottom of the intake nozzle 60 to facilitate the movement of the intake nozzle 60.

The intake nozzle 60 and the body 70 are rotatably connected within a predetermined angle range. In order words, the body 70 can be rotated backward with respect to the intake nozzle 60. To control the rotation between the body 70 and the intake nozzle 60, a lever is provided at an upper back side of the intake nozzle 60. When the lever is depressed, the body 70 can be rotated backward. That is, a user can adjust the angle between the body 70 and the intake nozzle 60 by rotating backward the body 70 by using the handle 80 while depressing the lever with the foot. Thus, the user can adjust the height of the upright vacuum cleaner 50 according to his/her height.

Further, the intake nozzle 60 includes a height-adjusting knob 64 on a top for adjustment of its height. The height-adjusting knob 64 is slidable in left and right directions. According to the condition of a surface to be cleaned, a user can shift down and up the intake nozzle 60 using the height-adjusting knob 64.

A motor and a suction fan are installed in the body 70 to generate suction power to draw air and foreign substances through the intake nozzle 70.

The body 70 includes a collector receiving portion 72 at a center portion, which is recessed from the front to the back to receive a dust collector 90. A lower portion of the collector receiving portion 72 may have a circular shape to correspond the shape of the dust collector 90. The collector receiving portion 72 includes a fixing protrusion 83 that is upwardly projected from a lower leading end to securely hold the dust collector 90 and thereby prevent the dust collector 90 from moving out of the dust collector receiving part 72 in a forward direction.

Under the collector receiving portion 72, a lamp 63 is provided to illuminate the front side. The lamp 63 may be a small light or an LED.

An exhaust unit 74 is installed to a lower left side of the body 70 when viewed from the back of the upright vacuum cleaner 50. Air passed through the dust collector 90 is discharged through the exhaust unit 74. The exhaust unit 74 includes an exhaust filter to further remove foreign substances from the air.

Figure 6:
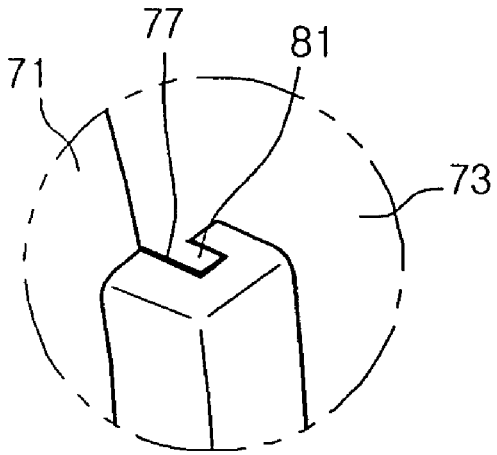
FIG. 6 is an enlarged view of the portion encircled by the circle labeled with "B" in FIG. 1, showing an coupling of an exhaust frame and an exhaust cover.

Also, the exhaust unit 74 may includes an exhaust frame (refer to 71 in FIG. 6) and an exhaust cover (refer to 73 in FIG. 6). The exhaust frame 71 may be attached to the body 70 or it may be formed integral with the body 70. The exhaust cover 73 may be coupled to the exhaust frame 71 to cover the exhaust filter.

FIG. 6 shows the coupling between the exhaust frame 71 and the exhaust cover 73.

Referring to FIG. 6, the exhaust frame 71 defines a groove 77 and the exhaust cover 73 includes a corresponding protrusion 81 for fitting into the groove 77. By inserting the protrusion 81 to the groove 77 and screwing the exhaust cover 73 to the exhaust frame 71, the exhaust cover 73 can be securely fixed to the exhaust frame 71.

Referring again to FIGS. 1 and 2, the body 70 includes a recessed nozzle receiving portion 76 on an upper front to receive a mini nozzle 78.

The mini nozzle 78 is relatively smaller than the intake nozzle 60, such that it can be used to clean narrow surfaces such as stair surfaces. The mini nozzle 78 includes a suction hole at a front for sucking dust and other material and a connection port 87 at a back for connection with a hose (not shown) connected to the body 70.

A nozzle support 85 is projected forwardly from a lower end of the nozzle receiving portion 76 to support a bottom of the mini nozzle 78. Also, an elastic fixing tab 75 is formed on an upper portion of the nozzle receiving portion 76 to elastically fix the connection port 87 of the mini nozzle 78. The elastic fixing tab 75 defines a semicircular recess to hold the connection port 87.

The body 70 further includes a coupling recess 79 in an upper end of the collector receiving portion 72 to receive a coupling lever 93 formed on a collector handle 92 of the dust collector 90. That is, a user can fix and remove the dust collector 90 to and from the collector receiving portion 72 by using the coupling lever 93.

The dust collector 90 collects dust and other material that is sucked through the intake nozzle 60. The dust collector 90 is detachably installed in the collector receiving portion 72. The dust collector 90 may collect the dust and other material from air by utilizing a cyclone effect, a filter, or a combination thereof.

The dust collector 90 includes a collector case 91 to hold a dust collecting unit and a collector cover 97 to close the top of the collector case 91. The collector handle 92 is formed on the collector cover 97.

The coupling lever 93 is formed on the collector handle 92 for locking and unlocking the dust collector 90 to the collector receiving portion 72. For this purpose, the coupling lever 93 is hinged to the collector handle 92, such that the coupling lever 93 can be rotated into and out of the coupling recess 79.

The handle 80 is extended upward from a top of the body 70 and bent rearward at a predetermined angle, such that a user can conveniently move the upright vacuum cleaner 50 by holding the handle 80. The handle 80 is formed with a plurality of operator buttons (not shown) at a front surface to receive operating conditions from a user.

The body 70 further includes a hose holder 94 that is protrusively formed on an upper back to hold a flexible connecting hose (not shown). The flexible connecting hose may be optionally used to guide drawn air or connect the mini nozzle 78 to the body 70.

A crevice tool 95 is detachably held on a back of the body 70. The crevice tool 95 is an additional nozzle for cleaning narrow surfaces or corners. The crevice tool 95 may be used after connecting it to a connecting hose (not shown).

The body 70 further includes a power cord 96 to receive power from an outer power source to operate the motor (not shown) installed therein. The power cord 96 is accommodated in a cord reel 100 in a wound condition.

The cord reel 100 is installed on a right lower side of the body 70 when viewed from the back of the upright vacuum cleaner 50. The cord reel 100 includes a cord reel frame 110 formed on the body 70, a cord reel cover 120 coupled to the cord reel frame 110, and a reel wheel 130 rotatably installed between the cord reel frame 110 and the cord reel cover 120 to wind the power cord 96 around it.

Also, the cord reel 100 includes a reel wheel shaft 102 perpendicular to the right lower side of the body 70. As shown, the cord reel 100 can be simply installed to the upright vacuum cleaner 50 without adding any complicated structure.

The cord reel frame 110 and the cord reel cover 120 have corresponding shapes to receive the reel wheel 130 therebetween. That is, the cord reel frame 110 includes a forwardly extended edge to form a wheel receiving portion 112 therein to receive the reel wheel 130.

The cord reel 100 is more clearly shown in FIG. 2, in which some components of the cord reel 100 are omitted for clarity.

The reel wheel 130 includes circular reel plates 132 disposed parallel with the cord reel frame 110 and a spool (not shown) formed between the reel plates 132 for winding the power cord 96 around it.

The reel wheel shaft 102 is protruded from a center of the cord reel frame 110 and it is inserted through the reel plates and the spool. That is, the reel wheel 130 is rotatably supported by the reel wheel shaft 102. By the rotation of the reel wheel 130, the power cord 96 can be wound and unwound. Further, a reel spring 134 is wound in the reel wheel 130 to offer elastic force when the power cord 96 is wound.

A brake unit 140 is installed to a predetermined portion of the cord reel frame 110 to control the rotation of the reel wheel 130. The brake unit 140 includes a release lever 142, a brake drum 144 at one end of the release lever 142, and a torsion spring 146 to press the brake drum 144 against the reel wheel 130.

The release lever 142 includes a lever axle 143 at a center, such that it can be rotated about the lever axle 143 with respect to the cord reel frame 110. The release lever 142 further includes one end where the brake drum 144 is formed and the other end that is selectively depressed by a pressing protrusion 154 of a cord reel button 150.

When a user pulls out a plug 99 of the power cord 96 to insert the plug 99 into a receptacle, the power cord 96 is extended from the cord reel 100 as the reel wheel 130 is rotated clockwise. Here, the brake drum 144 is also moved in a right direction by the reel plate 132. In detail, a drum axle 147 of the brake drum 144 is guided by a slot 145 when the brake drum 144 is moved by the reel plate 132.

When the user does not pull out the plug 99, the brake drum 144 is tightly pressed against the reel wheel 130 to apply braking force to the reel wheel 130. Thus, the upright vacuum cleaner 50 can be used while maintaining the power cord 96 in the extended condition. In detail, the brake drum 144 applies the braking force to the reel wheel 130 as follows: when the pulling force is removed from the plug 99, the reel wheel 130 is rotated a bit in a counterclockwise by the reel spring 134; the brake drum 144 is moved a bit in a left direction by the rotation of the reel wheel 130 while the drum axle 147 is guided by the slot 145; and then the brake drum 144 is squeezed between a stopper 149 and the reel plate 132 to apply braking force to the reel wheel 130. Here, the stopper 149 is a structure formed integral with the cord reel frame 110 to press the brake drum 144 against the reel plate 132. For this, the stopper 149 is sloped down from right to left (that is, the stopper becomes closer to the reel plate 132 as it goes in a left direction).

That is, when the reel wheel 130 rotates counterclockwise, the brake drum 144 gets in between the stopper 149 and the reel plate 132 to act as a wedge to prevent further rotation of the reel wheel 130.

The cord reel cover 120 is coupled to the cord reel frame 110 from the front to define a predetermined space therebetween to receive the reel wheel 130. The coupling of the cord reel cover 120 to the cord reel frame 110 will now be more fully described.

Figure 3:
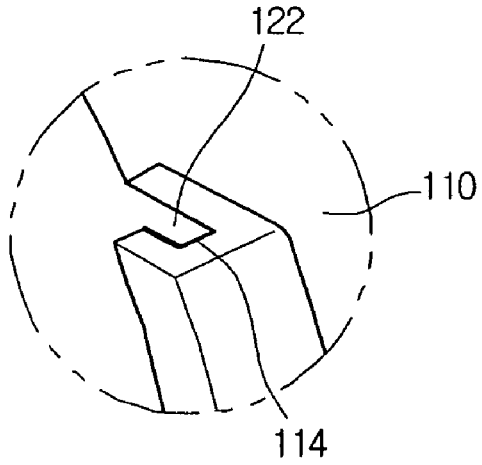
FIG. 3 is an enlarged view of the portion encircled by the circle labeled with "C" in FIG. 1.
Figure 4:
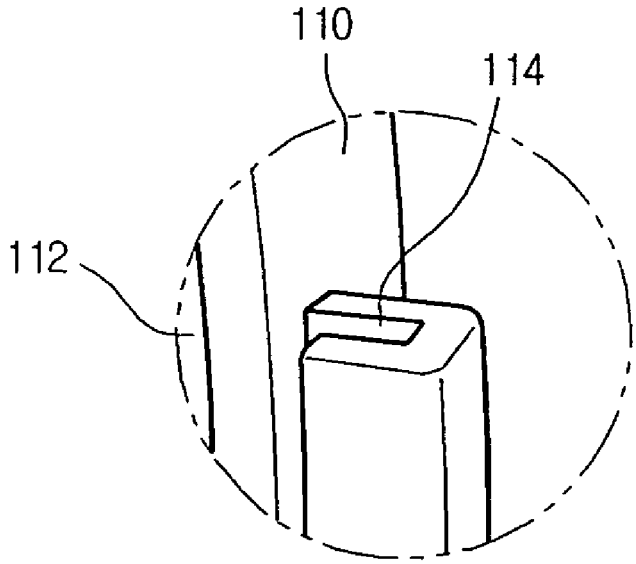
FIG. 4 is an enlarged view of the portion encircled by the circle labeled with "D" in FIG. 2.

FIG. 3 is an enlarged view of the portion encircled by the circle labeled with "C" in FIG. 1, showing the cord reel cover 120 coupled to the cord reel frame 110. FIG. 4 is an enlarged view of the portion encircled by the circle labeled with "D" in FIG. 2, showing the cord reel frame 110 without the cord reel cover 120.

Referring to FIGS. 3 and 4, the cord reel frame 110 is formed with a coupling groove 114 at a front right edge, and the cord reel cover 120 is formed with a coupling protrusion 122 at a corresponding portion to the coupling groove 114. That is, the cord reel frame 110 includes a projection at a front right edge to define the coupling groove 114 in a vertical direction. By inserting the coupling 122 to the coupling groove 114, the cord reel cover 120 can be fixed to the cord reel frame 110.

Also, the cord reel frame 110 includes screw holes 116 (refer to FIG. 2) at front left edge portions to receive screws 124. By fitting the screws 124 into the screw holes 116, the left side of the cord reel cover 120 can be securely fixed to the cord reel frame 110.

That is, one side of the cord reel cover 120 is fixed to the cord reel frame 110 by inserting the coupling protrusion 122 into the coupling groove 114, and the other side of the cord reel cover 120 is fixed to the cord reel frame 110 by fitting the screws 124 into the screw holes 116, such that the cord reel cover 120 can be securely fixed to the cord reel frame 110 that is integrally formed with the body 70 of the upright vacuum cleaner 50. Since the cord reel frame 110 is integral with the body 70, other structure for fixing the cord reel frame 110 to the body is not required. Also, the cord reel frame 110 can be formed integral with the body 70 through a simple process.

Figure 7:
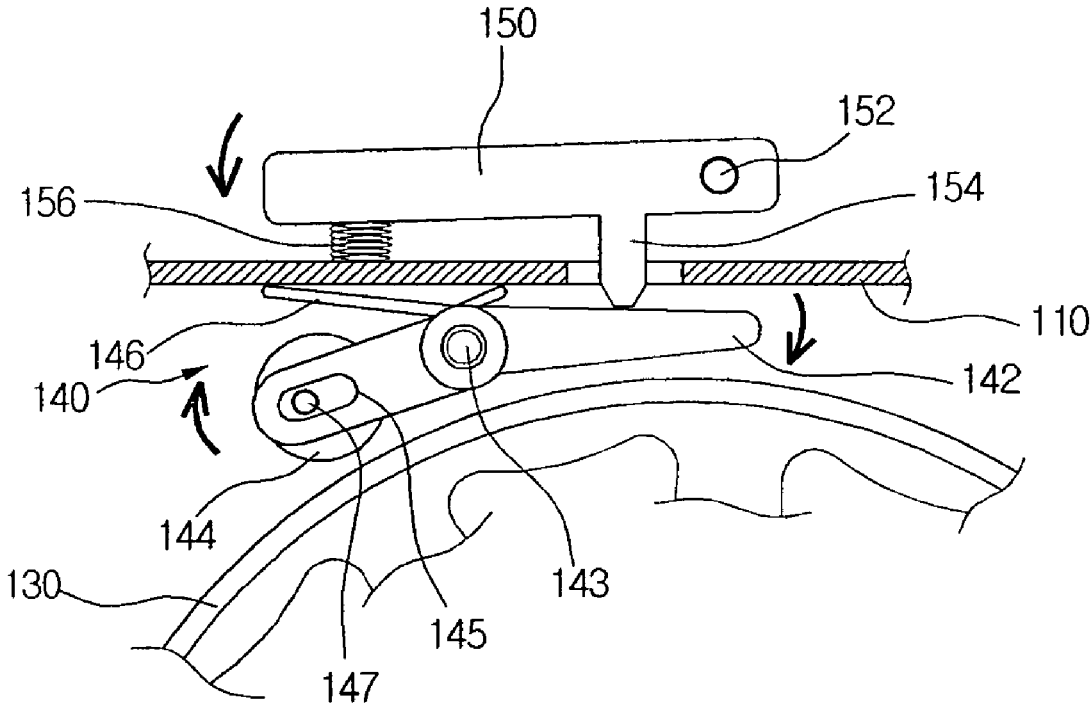
FIG. 7 shows a brake unit of the upright vacuum cleaner depicted in FIG. 1.

FIG. 7 shows an operation of the brake unit 140.

Referring to FIG. 7, the cord reel button 150 is installed above the cord reel frame 110. The cord reel button 150 is rotatable about a button axle 152 formed at a right end thereof. The cord reel button 150 is provided to selectively depress the release lever 142 of the brake unit 140 to control the rotation of the release lever 140.

The cord reel button 150 includes the pressing protrusion 154 on a right bottom surface. When the cord reel button 150 is depressed, the pressing protrusion 154 presses the release lever 142 to rotate it clockwise. Rotations of components of the brake unit 140 by the cord reel button 150 are indicated by arrows in FIG. 7.

Further, the cord reel button 150 includes a compression spring 156 to move the cord reel button 150 to its original position after the cord reel button 150 is pressed. That is, after the cord reel button 150 is rotated down about the button axle 152, it can be rotated up to its original position by the compression spring 156.

Figure 5:
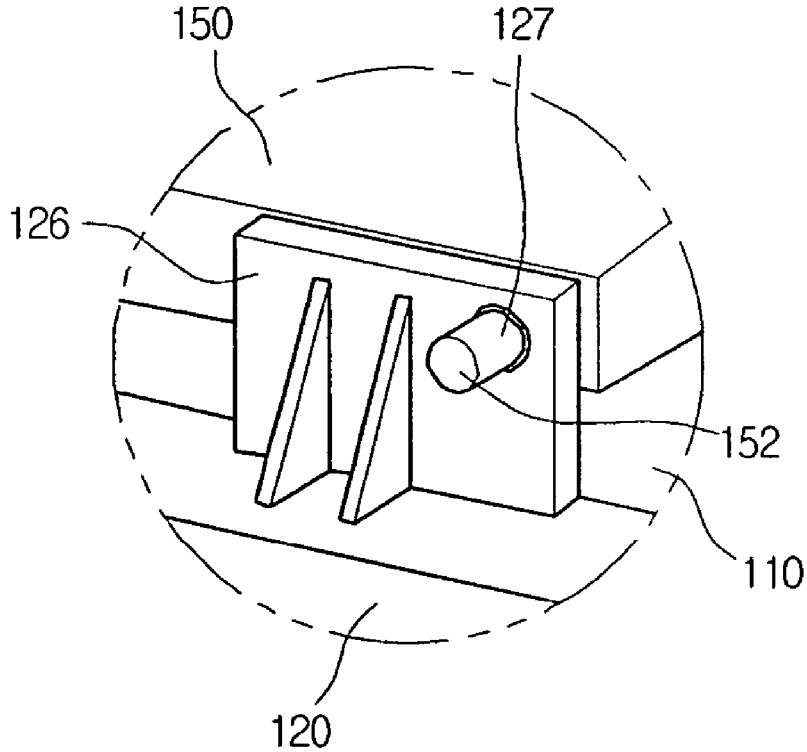
FIG. 5 is an enlarged view of the portion encircled by the circle labeled with "A" in FIG. 1.

FIG. 5 is an enlarged view of the portion encircled by the circle labeled with "A" in FIG. 1. Referring to FIG. 5, a button axle support 126 is protruded from a top of the cord reel cover 120 to support the button axle 152 of the cord reel button 150. The button axle support 126 defines a button axle hole 127 to receive the button axle 152. That is, the button axle 152 is rotatably supported by the button axle support 126.

An operation of the upright vacuum cleaner 50 will now be described.

First, the motor installed in the body 70 is operated to generate suction force. By this suction force, dust, other material, and air is sucked through a suction hole defined at a bottom of the intake nozzle 60 and they are directed into the body 70 where the dust collector 90 is installed. The dust collector 90 collects the dust and other material from the air and discharges the air back to the body 70.

Then, the air discharged from the dust collector 90 to the body 70 is directed to the exhaust unit 74 after passing by the motor. Through the exhaust unit 74, the air is finally discharged to the outside.

If a user wants to clean narrow surfaces such as stair surfaces, the user can use the mini nozzle 78 attached on a front of the body 70. The user can connect the mini nozzle 78 to a connecting hose after detaching it from the front of the body 70. Further, if the user wants to clean corners or crevices, the user can use the crevice tool 95 by connecting it to the connecting hose.

An operation of the cord reel 100 will now be described with reference to FIGS. 1, 2, and 7.

When a user pulls out the plug 99 to insert it into a receptacle, the power cord 96 is released from the reel wheel 130. While the power cord 96 is pulled out, the brake unit 140 does not brake the reel wheel 130 so that the power cord 96 can be smoothly pulled out from the reel wheel 130.

When the user stops pulling after the power cord 96 is extended a desired length, the brake drum 144 is pressed against the reel wheel 130 to apply braking force to the reel wheel 130. Therefore, the user can use the upright vacuum cleaner 50 while keeping the power cord 96 in the extended condition. As described above, since the brake drum 144 is squeezed between the stopper 149 and the reel plate 132 as like a wedge, the brake drum 144 can apply the braking force to the reel wheel 130.

Here, the cord reel button 150 is kept in an upper position by the compression spring 156 as shown in FIG. 2.

To retract the power cord 96 into the reel wheel 130 after cleaning, the user can press the cord reel button 150. When pressed, the cord reel button 150 is rotated down about the button axle 152 in a counterclockwise as shown in FIG. 7.

When the cord reel button 150 is rotated down, the pressing protrusion 154 of the cord reel button 150 presses a left side of the release lever 142 to rotate it in a clockwise. Thus, the brake drum 144 is spaced apart from the reel plate 132. That is, the brake drum 144 is moved up along the stopper 149 by the release lever 142, such that the braking force applied to the reel plate 132 can be removed.

Since the braking force is removed, the reel wheel is rotated by the elastic force of the reel spring 134 to wind the power cord 96 around it.

After the power cord 96 is sufficiently wounded around the reel wheel 130, the user stops pressing the cord reel button 150. When the pressing force is removed, the cord reel button 150 is rotated up by the compression spring 156 and thus the release lever 142 is rotated counterclockwise by the torsion spring 146. By the rotation of the release lever 142, the brake drum 144 is reinserted between the stopper 149 and the reel wheel 130 to apply braking force to the reel wheel 130, thereby preventing rotation of the reel wheel 130.

It will be apparent to those skilled in the art that various modifications and variations can be made in the present invention. Thus, it is intended that the present invention covers the modifications and variations of this invention provided they come within the scope of the appended claims and their equivalents.

For example, though the cord reel 100 and the exhaust unit 74 are respectively installed to the right side and left side of the body 70 when viewed from the back of the upright vacuum cleaner 50 in FIG. 1, the opposite configuration may be available. That is, the cord reel 100 and the exhaust unit 74 may be respectively installed to the left side and right side of the body 70.

Further, the cord reel 100 may be installed inside of the body 70 instead of installing it on an outer side of the body 70.

As described above, the cord reel and the exhaust unit are respectively installed to the lower lateral sides of the upright vacuum cleaner in a symmetric manner, such that the upright vacuum cleaner can be balanced. That is, the gravity center of the upright vacuum cleaner can be located at a lower position along the center line, such that the upright vacuum cleaner can be stably used with less possibility of falling down.

Also, the power cord is kept inside of the cord reel when not used such that it does not degrade the outer appearance of the upright vacuum cleaner. That is, the upright vacuum cleaner can have a more good appearance when the power cord is kept inside of the cord wheel according to the present invention, than when the power cord is hanged on the back of the upright vacuum cleaner according to the related art.

Further, since the cord reel is installed to the lower portion of the upright vacuum cleaner, the power cord can be easily pulled out from the cord reel with less possibility of getting the upright vacuum cleaner down.

Furthermore, since the power cord can be easily extended and retracted from and into the cord reel of the vacuum cleaner, the user can use the upright vacuum cleaner more conveniently.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An upright vacuum cleaner comprising:

an intake nozzle to suck air, dust, and other material;

a body extended upward from the intake nozzle;

a dust collector installed in the body to remove the dust and other material from the air;

a handle extended upward from the body and then bent backward at a predetermined angle;

a cord reel installed on a first side of the body to accommodate a power cord, wherein the cord reel includes:

a cord reel frame integrally formed with the body having a coupling groove at one edge and screw holes at another edge to receive screws; and a cord reel cover coupled to the cord reel frame having a coupling protrusion at a corresponding portion of the coupling groove;

a release lever configured to be rotatable with respect to the cord reel frame;

a cord reel button provided at the cord reel frame to control the rotation of the release lever, wherein the cord reel button is rotatable about a button axle;

a button axle support configured to protrude from a top of the cord reel cover to support the button axle, defining a button axle hole to receive the button axle; and an exhaust unit formed on a side opposite the first side to discharge the air from the dust collector to an outside of the upright vacuum cleaner.

2. The upright vacuum cleaner according to claim 1, wherein the power cord is extendable and retractable from and into the cord reel from a back of the body.

3. The upright vacuum cleaner according to claim 1, wherein the cord reel button is at an upper side to control the retraction of the power cord.

4. An upright vacuum cleaner comprising:

an intake nozzle to suck air, dust, and other material;

a body extended upward from the intake nozzle in a rotatable relationship with the intake nozzle;

a dust collector installed in the body to remove the dust and other material from the air;

a cord reel installed on an outer, lower side of the body to accommodate a power cord; and an exhaust unit formed on an outer, lower side of the body opposite from the cord reel to discharge the air from the dust collector to an outside of the upright vacuum cleaner, wherein the cord reel and the exhaust unit are respectively installed one on either side of the body in a transverse symmetric manner such that the center of gravity of the upright vacuum cleaner is located at a lower position along a center longitudinal line of the body, wherein the cord reel further includes:

a cord reel frame integrally formed with the body;

a cord reel cover having corresponding shapes to receive a reel wheel;

a release lever configured to be rotatable with respect to the cord reel frame;

a cord reel button provided at the cord reel frame to control the rotation of the release lever, wherein the cord reel button is rotatable about a button axle; and a button axle support configured to protrude from a top of the cord reel cover to support the button axle, defining a button axle hole to receive the button axle.

* * * * *